US010226662B1

(12) United States Patent
Mink

(10) Patent No.: US 10,226,662 B1
(45) Date of Patent: Mar. 12, 2019

(54) MULTIPURPOSE EXERCISE DEVICE

(71) Applicant: Christopher John Mink, Apopka, FL (US)

(72) Inventor: Christopher John Mink, Apopka, FL (US)

( * ) Notice: Subject to any disclaimer, the term of this patent is extended or adjusted under 35 U.S.C. 154(b) by 58 days.

(21) Appl. No.: 15/218,367

(22) Filed: Jul. 25, 2016

Related U.S. Application Data

(60) Provisional application No. 62/198,177, filed on Jul. 29, 2015.

(51) Int. Cl.
*A63B 1/00* (2006.01)
*A63B 21/00* (2006.01)
(Continued)

(52) U.S. Cl.
CPC ..... *A63B 21/4029* (2015.10); *A63B 1/00* (2013.01); *A63B 21/068* (2013.01);
(Continued)

(58) Field of Classification Search
CPC .. A63B 1/00; A63B 1/005; A63B 3/00; A63B 21/00047; A63B 21/0005; A63B 21/00054; A63B 21/068; A63B 21/078; A63B 21/0783; A63B 21/08; A63B 21/4027; A63B 21/4029; A63B 21/4033; A63B 21/4035; A63B 21/4047; A63B 21/4049; A63B 2023/003; A63B 2023/006; A63B 2023/0411; A63B 23/02; A63B 23/0205; A63B 23/0211; A63B 23/0216; A63B 23/0222; A63B 23/0233; A63B 23/035; A63B 23/03508; A63B 23/0356; A63B 23/0355; A63B 23/03575; A63B 23/04; A63B 23/0405; A63B 23/0458; A63B 23/0482; A63B 23/0488; A63B 23/0494; A63B 23/12; A63B 23/1209; A63B 23/1218; A63B 23/1227; A63B 23/1236; A63B 23/1245; A63B 23/1281; A63B 69/0028; A63B 69/0035; A63B 2208/02; A63B 2208/0204; A63B 2208/0209; A63B 2208/0214; A63B 2208/0219; A63B 2208/0223; A63B 2208/0228; A63B 2208/0233; A63B 2208/0238; A63B 2208/0242; A63B 2208/0247; A63B 2208/0252; A63B 2208/0257; A63B 2208/0261; A63B 2208/0266; A63B 2208/0271;
(Continued)

(56) References Cited

U.S. PATENT DOCUMENTS 2,783,045 A * 2/1957 Bosch ..... A63B 21/068 482/135
3,339,920 A * 9/1967 Moritz ..... A63B 9/00 182/181.1
(Continued)

*Primary Examiner* — Gary D Urbiel Goldner
(74) *Attorney, Agent, or Firm* — H. John Rizvi; Gold & Rizvi, P.A.

(57) ABSTRACT

A multipurpose exercise device including a frame and a panel. The frame includes a plurality of legs, and a support assembly that secures the legs in a vertical position, or allows the legs to freely rotate to allow the frame to fold flat. The support assembly includes an adjustment mechanism to adjust a distance between the legs. A panel is detachably securable to the frame in a flat or inclined position.

13 Claims, 12 Drawing Sheets

(51) Int. Cl.
*A63B 21/068* (2006.01)
*A63B 23/02* (2006.01)
*A63B 23/04* (2006.01)
*A63B 23/12* (2006.01)

(52) U.S. Cl.
CPC ..... *A63B 21/4035* (2015.10); *A63B 23/0211* (2013.01); *A63B 23/0405* (2013.01); *A63B 23/0458* (2013.01); *A63B 23/1218* (2013.01); *A63B 23/1227* (2013.01); *A63B 2023/0411* (2013.01)

(58) Field of Classification Search
CPC ..... A63B 2208/0276; A63B 2208/028; A63B 2208/0285; A63B 2208/029; A63B 2208/0295; A63B 2210/50; A63B 2225/09; A63B 2225/093; A63B 2225/10
See application file for complete search history.

(56) References Cited

U.S. PATENT DOCUMENTS 3,948,513 A * 4/1976 Pfotenhauer ..... A63B 17/04 482/142
4,871,166 A * 10/1989 Sterba ..... A63B 23/00 482/142
5,018,727 A * 5/1991 Cornell ..... A63B 21/078 482/104
5,042,801 A * 8/1991 Sterba ..... A63B 23/00 482/137
5,100,130 A * 3/1992 Shoebrooks ..... A63B 21/4039 482/121
5,125,883 A * 6/1992 Shoebrooks ..... A63B 21/4039 482/121
5,199,940 A * 4/1993 Morris ..... A61F 5/055 128/845
5,306,220 A * 4/1994 Kearney ..... A63B 23/00 482/104
5,320,592 A * 6/1994 Olschansky ..... A63B 23/00 482/142
5,346,448 A * 9/1994 Sollo ..... A63B 21/00181 482/104
5,403,258 A 4/1995 Hill
5,421,800 A 6/1995 Mullen
D371,176 S 6/1996 Furner
5,611,762 A 3/1997 Kaye
5,665,038 A * 9/1997 Miller ..... A63B 21/078 482/104
5,810,702 A * 9/1998 Wilkinson ..... A63B 21/00047 482/130
5,938,576 A 8/1999 Minor
6,027,433 A * 2/2000 Flynn ..... A63B 23/00 482/100
6,117,051 A 9/2000 Suarez et al.
6,168,548 B1 * 1/2001 Fleming ..... A63B 3/00 482/23
6,482,139 B1 * 11/2002 Haag ..... A63B 21/0552 482/121
7,833,144 B1 11/2010 Como et al.
8,568,281 B2 10/2013 Beaulieu et al.
2002/0094918 A1 * 7/2002 Gerschefske ..... A63B 21/023 482/92
2005/0003938 A1 * 1/2005 Henderson ..... A63B 21/068 482/143
2006/0189451 A1 * 8/2006 Nelson ..... A63B 22/0012 482/57
2007/0155602 A1 * 7/2007 Huls ..... A63B 21/00181 482/140
2007/0270293 A1 * 11/2007 Zhuang ..... A63B 21/023 482/123
2010/0105532 A1 * 4/2010 Israeli ..... A63B 1/00 482/131
2011/0251033 A1 * 10/2011 Blancher ..... A63B 21/0442 482/123

* cited by examiner

MULTIPURPOSE EXERCISE DEVICE

CROSS-REFERENCE TO RELATED APPLICATION

This application claims the benefit of U.S. Provisional Patent Application Ser. No. 62/198,177, filed Jul. 29, 2015, which is incorporated herein in its entirety.

FIELD OF THE INVENTION

The present invention relates generally to physical exercise devices, and more particularly to a convertible exercise device.

BACKGROUND OF THE INVENTION

It is common for a person to engage in physical exercise. For example, a person may desire to exercise muscle groups, such as pectoral, abdominal, latissimus dorsi, rhomboid, bicep, tricep, quadricep, hamstring or gluteus muscle groups.

A person may want to exercise different muscle groups in various ways. Frequently, a person may choose to utilize an exercise device to perform certain exercises. For example, a flat bench may be used to perform chest press exercises, or an inclined bench may be used to perform inclined chest press exercises. Further, a person may want to perform bodyweight dips or bodyweight pull-ups. Even further, a person may want to perform inclined crunch exercises, where a person hooks their feet under a foot support, and lies supine on an inclined board such that their head is lower than their hip, and flexes their waist and upper torso toward their legs. Alternatively, a person may grab with their hands a support at the top of the inclined bench, and perform leg raise exercises in a supine position. Another commonly performed exercise is step exercise, such as step aerobics, where a person may step up and down on a small step with alternating feet. Yet another commonly performed exercise is a torso rotation exercise, where a person holds a weighted device with extended arms in a standing position and rotates their torso by keeping the weighted device extended. Alternatively, a person may hold the weighted device above their head and perform sets of shoulder press exercises or squat exercises.

To provide these exercises, various exercise benches or devices have been developed. For example, a standard exercise bench may include a rotatable back rest to enable a user to perform flat and inclined chest press exercises. As another example, an exercise device may include dip bars and pull up bars to enable a person to perform bodyweight dips, pull ups or knee-ups. As yet another example, an abdominal crunch bench may include a sloped or inclined backrest to perform inclined crunches or inclined leg raises. Step exercises may be performed on a small step device, and torso rotation exercises may be performed by a person holding a weighted medicine ball or weight plate, or via a torso rotation machine. Shoulder press or squat exercises may be performed by a person holding a weighted device above their head and thrusting the weighted device repetitively.

In practice, a person wishing to carry out a complete exercising scheme must either purchase a wide variety of exercising devices or go to a gym or other sporting facility which allows the person to utilize a wide variety of exercise devices in exchange for a subscription fee payment. For example, one device merely provides dip exercises, one device merely provides pull up exercises, one device merely provides an inclined bench or declined bench, one device merely provides an inclined crunch bench, etc. Further, the above described common exercise devices are not effectively configured to fold flat for storage. Thus, there remains a need in the art for a more cost-effective and convenient exercising solution for those wanting to carry out or perform a wide variety of exercises.

SUMMARY OF THE INVENTION

This summary is provided to introduce a selection of concepts in a simplified form that are further described below in the detailed description. This summary is not intended to identify key features of essential features of the claimed subject matter, nor is it intended to be used to limit the scope of the claimed subject matter. Furthermore, the claimed subject matter is not limited to implementations that solve any or all disadvantages noted in any part of this disclosure.

According to embodiments of the present disclosure, a multifunctional foldable exercise device is disclosed that provides dip and pull up bars, an inclined and flat bench, support for performing incline crunches or leg raises, and that folds flat to a folded configuration for storage and provides a step for performing step exercises, and that can be held by a person for torso rotation exercises, overhead shoulder press exercises, or various manual exercises, without requiring additional dumbbells, weights, medicine balls or other exercise devices. The multifunctional exercise device includes a frame, the frame including, at least one pair of bars; an adjustment mechanism for selectively adjusting a distance between the pair of bars; a panel detachably securable to said frame. The panel may be detachably secured to the frame in either a flat or inclined position.

In another aspect, the pair of bars is securably and rotatably attachable to the frame.

In another aspect, the frame selectively folds flat.

In another aspect, the panel is detachably securable to the frame in a flat position.

In another aspect, the frame is self-supported in a horizontal or vertical position.

In another aspect, the pair of bars is able to support a person performing dip exercises.

In another aspect, the frame includes a support for supporting a person performing inclined crunch exercises when the panel is in an inclined position.

In another aspect, the panel detachably secures to the frame when the frame is in a flat position such that the exercise device may be used as a step platform for step exercises.

In another aspect, the adjustment mechanism includes a tubular sleeve that receives a bar.

In another aspect, the tubular sleeve includes a plurality of holes to receive force biased spring buttons disposed on the bar.

Disclosed is a multifunctional exercise device, comprising, a frame including a first pair of legs and a second pair of legs, a support assembly configured to support the pair of legs, the support assembly including a first lower support bar extending between the first pair of legs, and a second lower support bar extending between the second pair of legs, an adjustment mechanism for selectively adjusting a distance between the first and second lower support bars, and a panel detachably secured to the frame via a securing mechanism, wherein, with the panel detached from the frame, the first pair of legs is angularly separatable from the second pair of legs by a variable angle.

In another aspect, the frame further includes, a first upper support bar extending between the first pair of legs, and a second upper support bar extending between the second pair of legs.

In another aspect, the adjustment mechanism includes a first adjustment bar attached to the first lower support bar and configured to receive a second adjustment bar attached to the second lower support bar, the first adjustment bar including a plurality of adjustment holes for receiving a spring button of the second adjustment bar, such that the first lower support bar and the second lower support bar is separated by a first distance with the second adjustment bar received by the first adjustment bar at a first adjustment hole, and separated by a second distance with the second adjustment bar received by the first adjustment bar at a second adjustment hole.

In another aspect, with the panel detached from the frame, the frame is foldable flat with the first adjustment bar and the second adjustment bar being nearly parallel to the first pair of legs and the second pair of legs.

In another aspect, with the panel detached from the frame, the variable angle with which the first pair of legs is angularly separatable from the second pair of legs is selected by rotating one or both of the first pair of legs about a longitudinal axis of the first lower support bar and the second pair of legs about a longitudinal axis of the second lower support bar.

In another aspect, the adjustment mechanism includes a crossbar extending between the first lower support bar and the second lower support bar, and the panel includes a second securing mechanism at an underside of the panel, the panel being rotatably and detachably secured to the crossbar via the second securing mechanism such that the panel is inclined relative to the frame.

In another aspect, the adjustment mechanism includes a crossbar extending between the first lower support bar and the second lower support bar, and in a recessed position, the panel is positioned away from upper ends of the first pair of legs and the second pair of legs, the panel is in contact with the crossbar, and a dimension of the panel is less than the distance between the first lower support bar and the second lower support bar.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the claimed subject matter will hereinafter be described in conjunction with the appended drawings provided to illustrate and not to limit the scope of the claimed subject matter, where like designations denote like elements, and in which:

It is to be understood that like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
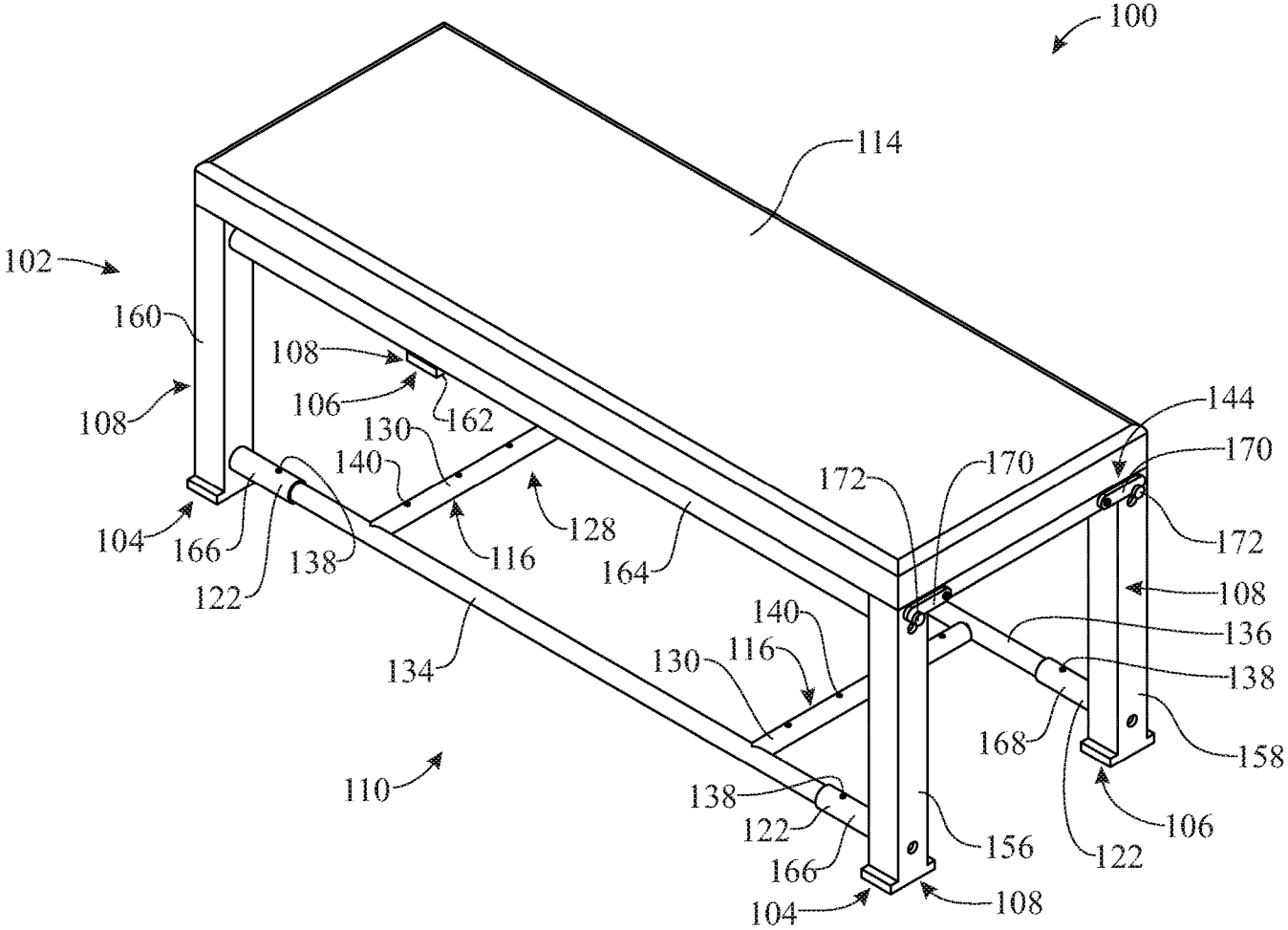
FIG. 1 presents an isometric top view of an exemplary exercise device in accordance with aspects of the invention.
Figure 4:
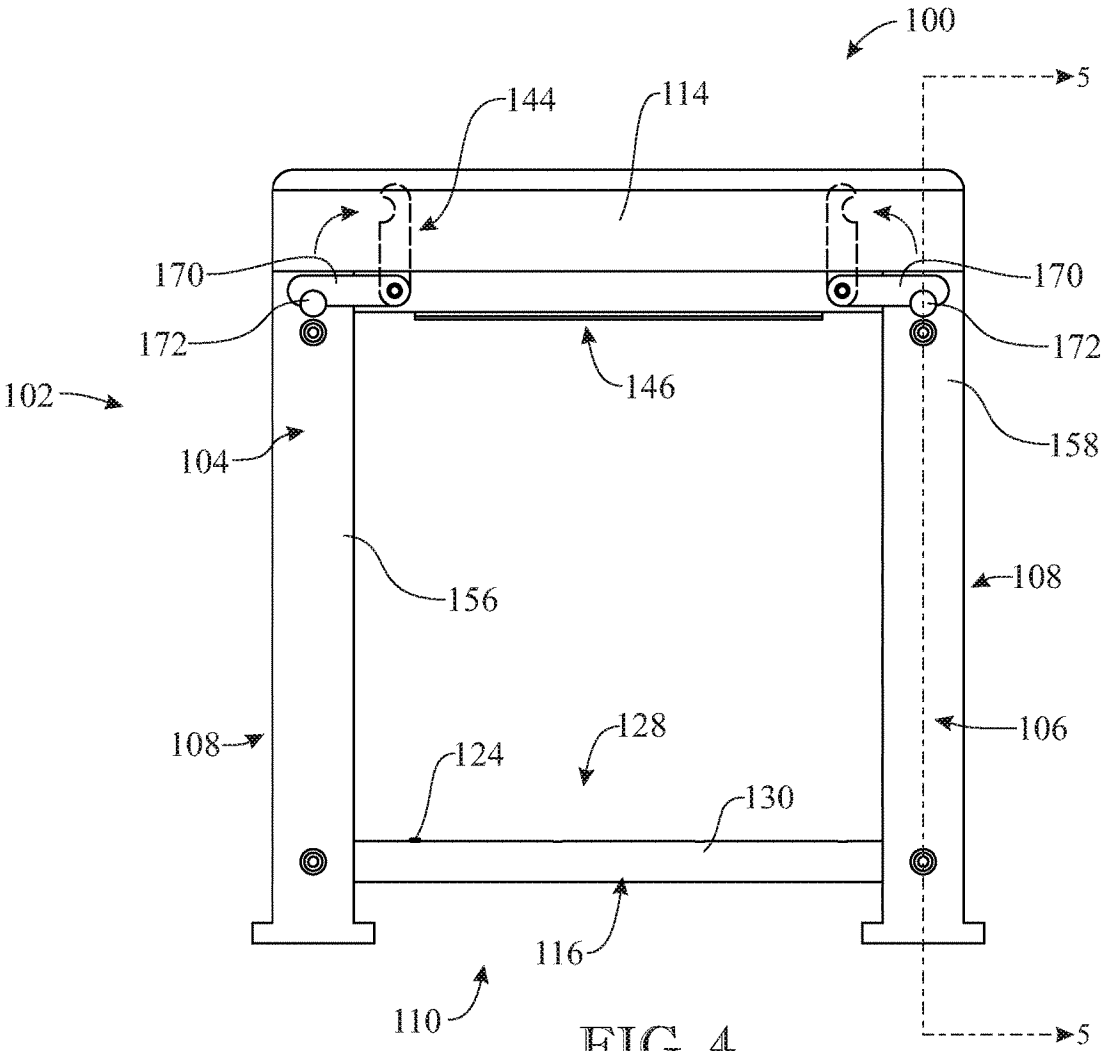
FIG. 4 presents a side elevation view of the exemplary exercise device of FIG. 1, in accordance with aspects of the invention.
Figure 5:
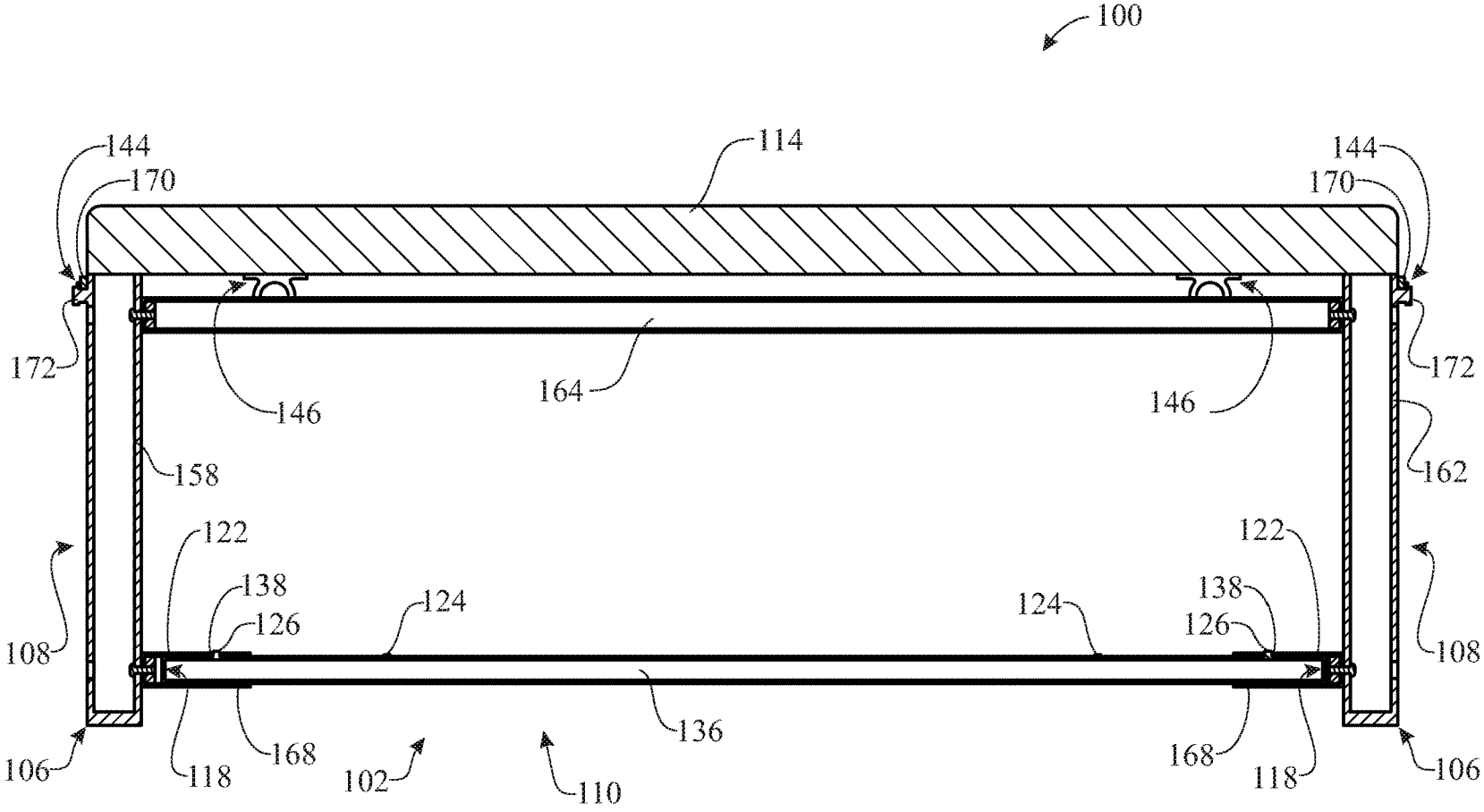
FIG. 5 presents a cross sectional elevated view of the exemplary exercise device of FIG. 1, where the cross section is taken along plane 5-5 indicated in FIG. 4, in accordance with aspects of the invention.
Figure 6:
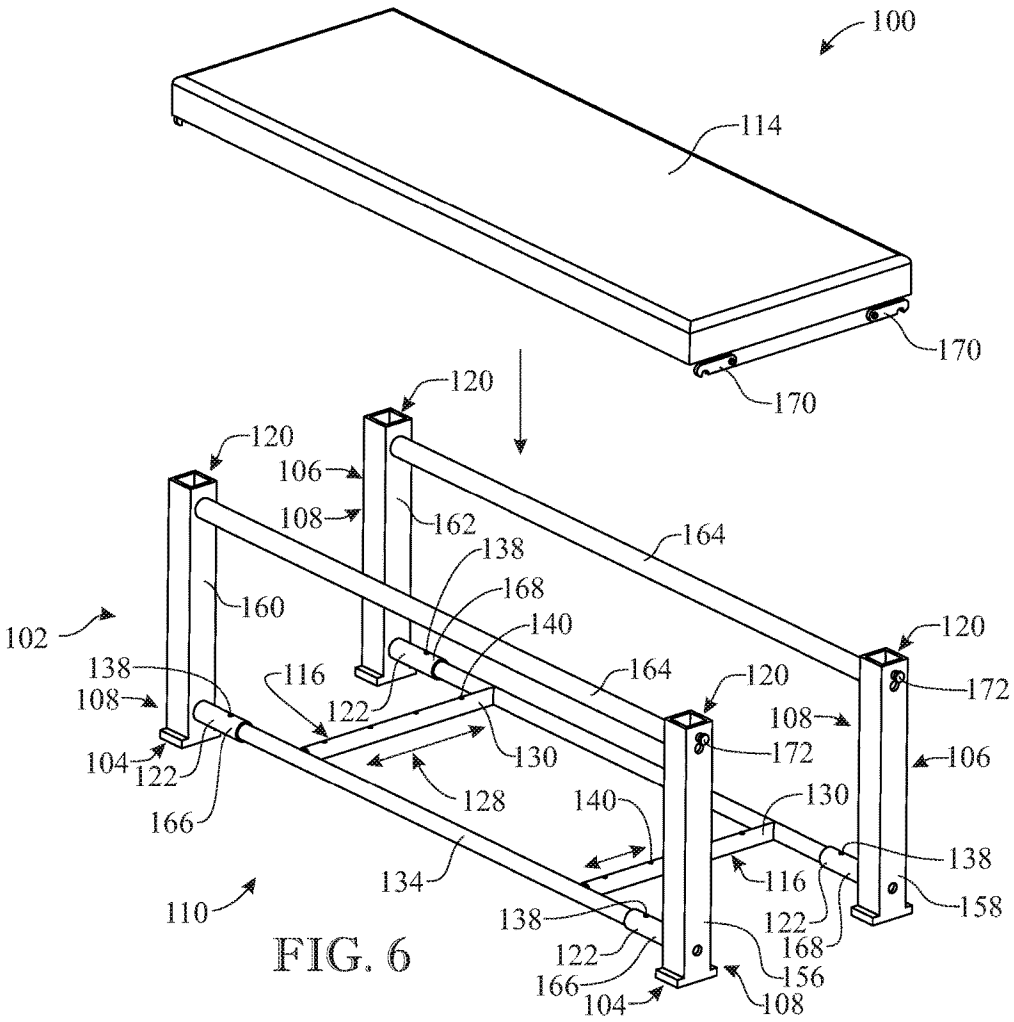
FIG. 6 presents an isometric top view of the exemplary exercise device of FIG. 1, where a panel is detached from a frame of the device, in accordance with aspects of the invention.

The illustrations of FIGS. 1-12 present an exercise device 100 in accordance with aspects of the present disclosure. As shown in FIG. 1 the exercise device 100 includes a frame 102. The frame 102 includes a plurality of legs 108 that are vertically supported by a support assembly 110. As shown in FIGS. 5 and 6, the frame 102 also includes two upper support bars 164 each attached between a first pair of legs 104 and a second pair of legs 106, respectively, near upper leg ends 120. Longitudinally opposite the upper leg ends 120 are lower leg ends (not indicated). For example, the lower leg ends rest on a surface when the exercise device is in the functional position of FIG. 1 where the panel is placed on top of the upper leg ends 120 to support an exercising user.

First pair of legs 104 and second pair of legs 106 may take any appropriate form, and may include any number of legs. For example, the frame 102 may include four legs disposed at corners of the frame 102. As another example, frame 102 may include two legs on opposite sides of support assembly 110. The support assembly 110 includes lower support bars 134 and 136 having longitudinal support ends 118. The support assembly 110 supports the legs 108 via bracings 122 that are disposed on the legs 108. For example, as shown in FIG. 5, each of the bracings 122 may include at least one bracing hole 138 that receives a force-biased spring button 126 that laterally protrudes from support ends 118 of the lower support bars 134 and 136 of the support assembly 110. The support assembly 110 is secured to the legs 108 when the spring buttons 126 are received by the bracing holes 138 of the bracings 122. For example, a user may insert support ends 118 of the support assembly 110 into bracings 122 such that the spring buttons 126 "click" or engage into the bracing holes 138 to selectively secure the legs 108 in a vertical position. When not secured to legs 108 (i.e. when the spring buttons 126 are not engaging the bracing holes 138), but when the support assembly 110 rests inside the bracings 122, the bracings 122 are rotatable relative to the support assembly 110 while being fixed respectively to the legs 108. For example, first bracing pair 166 and second bracing pair 168 are fixed to first pair of legs 104 and second pair of legs 106, respectively. The first bracing pair 166 receives first support bar 134 and the second bracing pair 168 receives second support bar 136 such that the first support bar 134 and the second support bar 136 rest inside the first bracing pair 166 and the second bracing pair 168, respectively. When the spring buttons 126 are not engaging the bracing holes 138, the first pair of legs 104 and the first bracing pair 166 are rotatable about a longitudinal axis of the first support bar 134, while the first support bar 134 remains stationary. Similarly, the second pair of legs 106 and the second bracing pair 166 are rotatable about a longitudinal axis of the second support bar 136 while the second support bar 136 remains stationary. In other words, the bracings 122 rotate around respectively received support ends 118 such that respective legs 108 also rotate around the support ends 118 since the legs are fixed to the bracings 122. Alternatively, legs 108 may include a rotatable bracing that respectively fixes onto support ends 118 to rotate the legs 108 along a longitudinal axis of the first support bar 134 and second support bar 136. It is to be understood that the lower support bars 134 and 136 may or may not be hollow, and may have any appropriate diameter or finish. Further, bracings 122 may take any form to rotatably or detachably secure the support assembly 110 without departing from scope of this disclosure. For example, bracings 122 may include a tubular sleeve that may receive the lower support bars 134 and 136. Any appropriate number of support bars or legs may be included without departing from scope of this disclosure.

Figure 2:
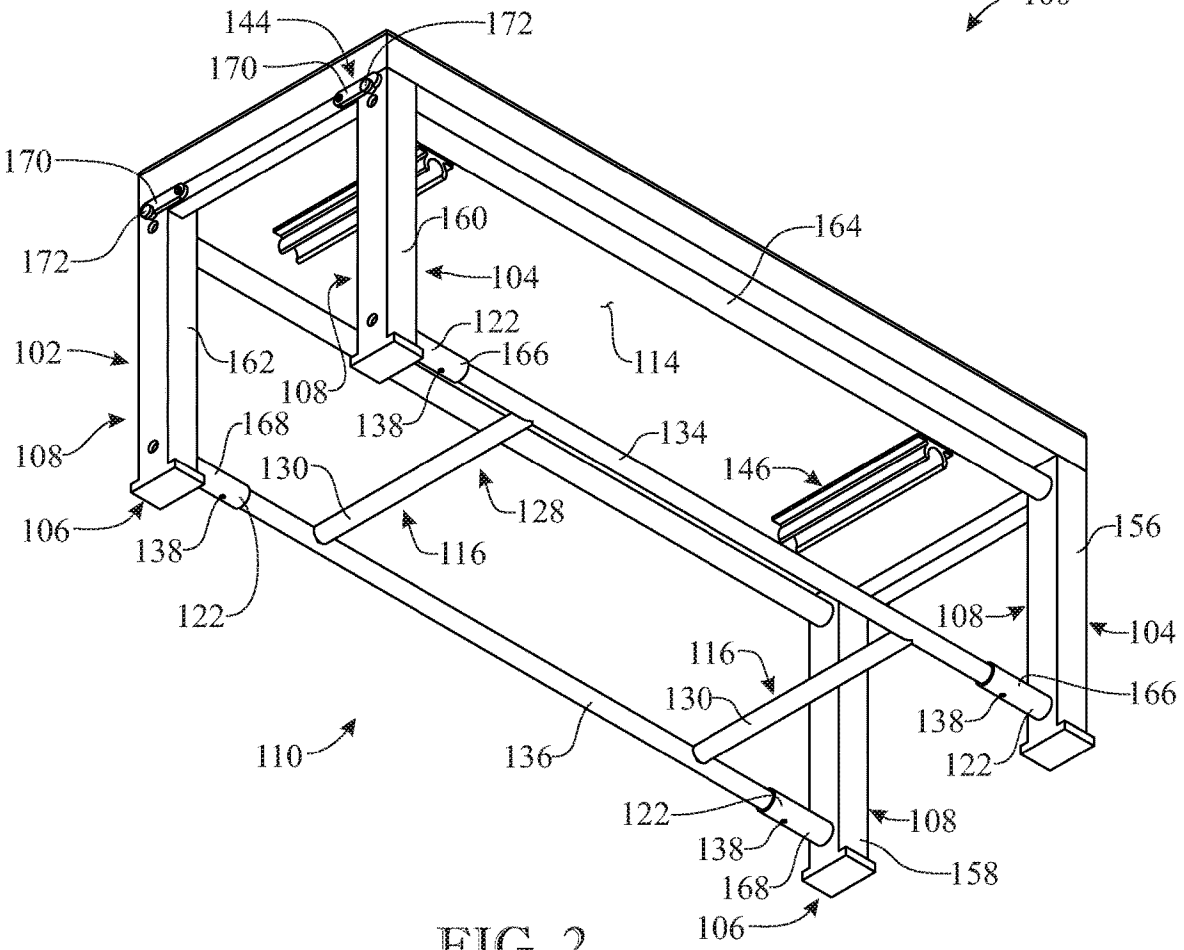
FIG. 2 presents an isometric bottom view of the exemplary exercise device of FIG. 1, in accordance with aspects of the invention.
Figure 3:
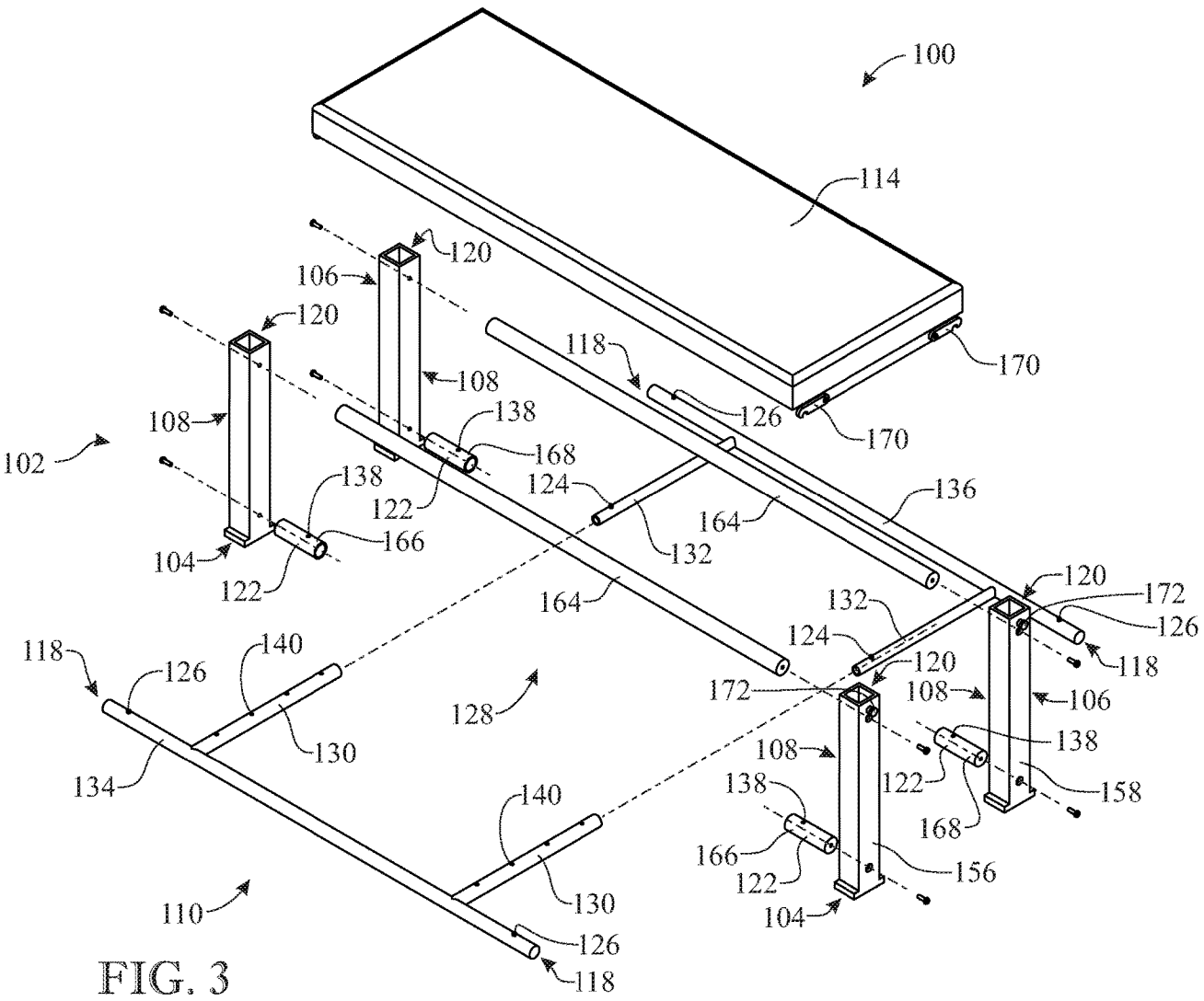
FIG. 3 presents an isometric exploded top view of the exemplary exercise device of FIG. 1, in accordance with aspects of the invention.

The support assembly 110 includes an adjustment mechanism 128 to adjust a distance between the legs 108 and provide additional support to the frame 102 when the support assembly 110 rests or is secured inside bracings 122. For example, the adjustment mechanism 128 may include a first adjustment bar 130 and a second adjustment bar 132 each attached to the lower support bars 134 and 136 respectively. For example, first adjustment bar 130 may be attached to first support bar 134 and second adjustment bar 132 may be attached to second support bar 136. The first adjustment bar 130 and the second adjustment bar 132 may be welded to the lower support bars 134 and 136. The first adjustment bar 130 may be or may include a sleeve that receives the second adjustment bar 132, forming a crossbar 116, as shown in FIG. 2. As such, the first adjustment bar 130 may include adjustment holes 140 similar to bracing holes 138. The second adjustment bar 132 may include one or more laterally protruding adjustment spring buttons 124, such that the second adjustment bar 132 may be inserted into the first adjustment bar 130 and such that the adjustment spring buttons 124 are received by the adjustment holes 140 to selectively secure the first adjustment bar 130 and the second adjustment bar 132 at a desired position. For example, the second adjustment bar 132 may be inserted and secured into the first adjustment bar 130 to a desired distance by selecting which hole of adjustment holes 140 the adjustment spring button 124 is to engage. As such, the crossbar 116 may have a variable length to accommodate adjustment of the distance between the lower support bars 134 and 136. Further, when the support assembly 110 is secured to legs 108 or when the support assembly 110 rests in bracings 122, the adjustment mechanism 128 may be operated to select or choose a distance between legs 108, or more particularly, a distance between first pair of legs 104 and second pair of legs 106. Further, the adjustment mechanism 128 may be operated to adjust a distance between the pair of upper support bars 164, or between the pair of lower support bars 134 and 136. For example, first pair of legs 104 may be selectively distanced from second pair of legs 106 by operating adjustment mechanism 128 to select or choose a distance between the pair of upper support bars 164. It is to be understood that second adjustment bar 132 may include any number of adjustment spring buttons 124 and first adjustment bar 130 may include any number of adjustment holes 140. The first adjustment bar 130 and the second adjustment bar 132 may be hollow, tubular, and/or cylindrical bars of any appropriate diameter or cross sectional shape. Even further, the adjustment mechanism 128 may include a plurality of adjustment bars or crossbars 116. For example, FIGS. 1-12 show the support assembly 110 and adjustment mechanism 128 including two crossbars 116. Adjustment mechanism 128 may include any appropriate mechanism to adjust a distance between upper support bars 164 or between first pair of legs 104 or second pair of legs 106.

The elements of exercise device 100 may be positioned in various ways in relation to each other. As shown in the drawings, the crossbars 116 may be substantially parallel to one another, and substantially perpendicular to lower support bars 134 and 136. Further, the legs 108 may be substantially parallel to each other when secured in a vertical position, and substantially orthogonal to the lower support bars 134 and 136 and upper support bars 164. The lower support bars 134 and 136 may be substantially parallel to each other. Upper support bars 164 may be substantially parallel to each other. Upper support bars 164 may include two substantially coplanar bars. The lower support bars 134 and 136 and crossbars 116 may be coplanar.

The exercise device 100 includes a panel 114 which is configured to be detachably securable to the frame 102. For example, FIG. 6 shows the panel 114 about to be placed on the frame 102. More particularly, the panel 114 is configured to rest on longitudinal leg ends 120 of the legs 108 when the legs 108 are supported in a vertical position, and when the distance between the legs 108 are appropriately adjusted via adjustment mechanism 128 to properly engage and support the panel 114. Though not shown, in some embodiments the panel 114 may include indentations shaped to mate with and receive leg ends 120. Further, the illustration of FIG. 4 shows the panel 114 being attached to the frame 102 via a first securing mechanism 144. More particularly, the first securing mechanism 144 includes latches 170 that latch onto receiving pins 172 located on the frame 102, as seen more closely in FIG. 4. First securing mechanism 144 may be disposed on the panel 114 or on the frame 102. The first securing mechanism 144 may include any appropriate securing device to detachably secure the panel 114 to the frame 102. For example, push-pin, magnetic, slide-lock, or spring button devices may be included as part of first securing mechanism 144 or on any element or part of frame 102. The panel 114 may include various pads, cushions, or comfort devices to provide comfort to a person sitting, lying or resting on panel 114.

Figure 7:
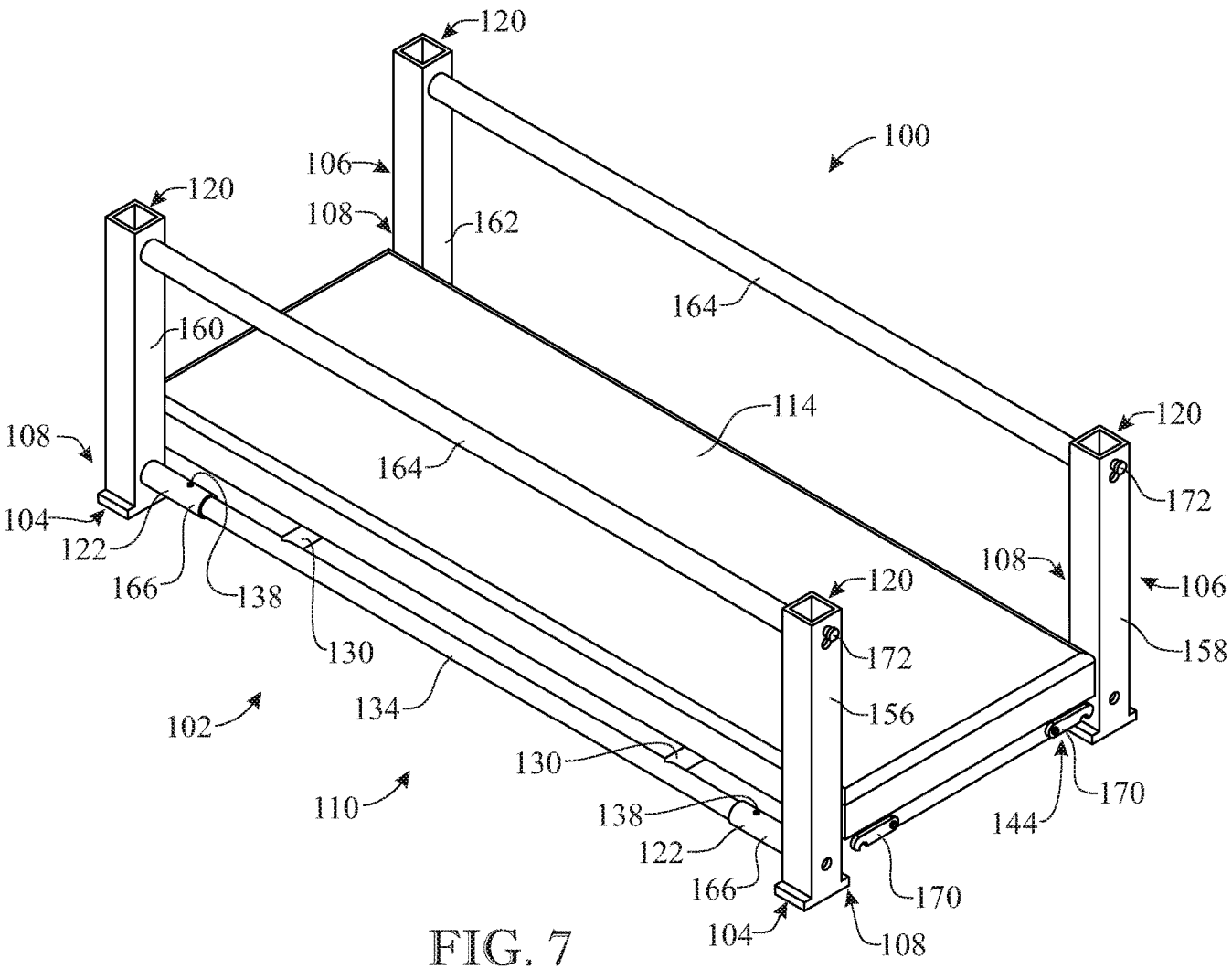
FIG. 7 presents an isometric top view of the exemplary exercise device of FIG. 1, where the panel is placed in between a pair of bars of the device, in accordance with aspects of the invention.
Figure 8:
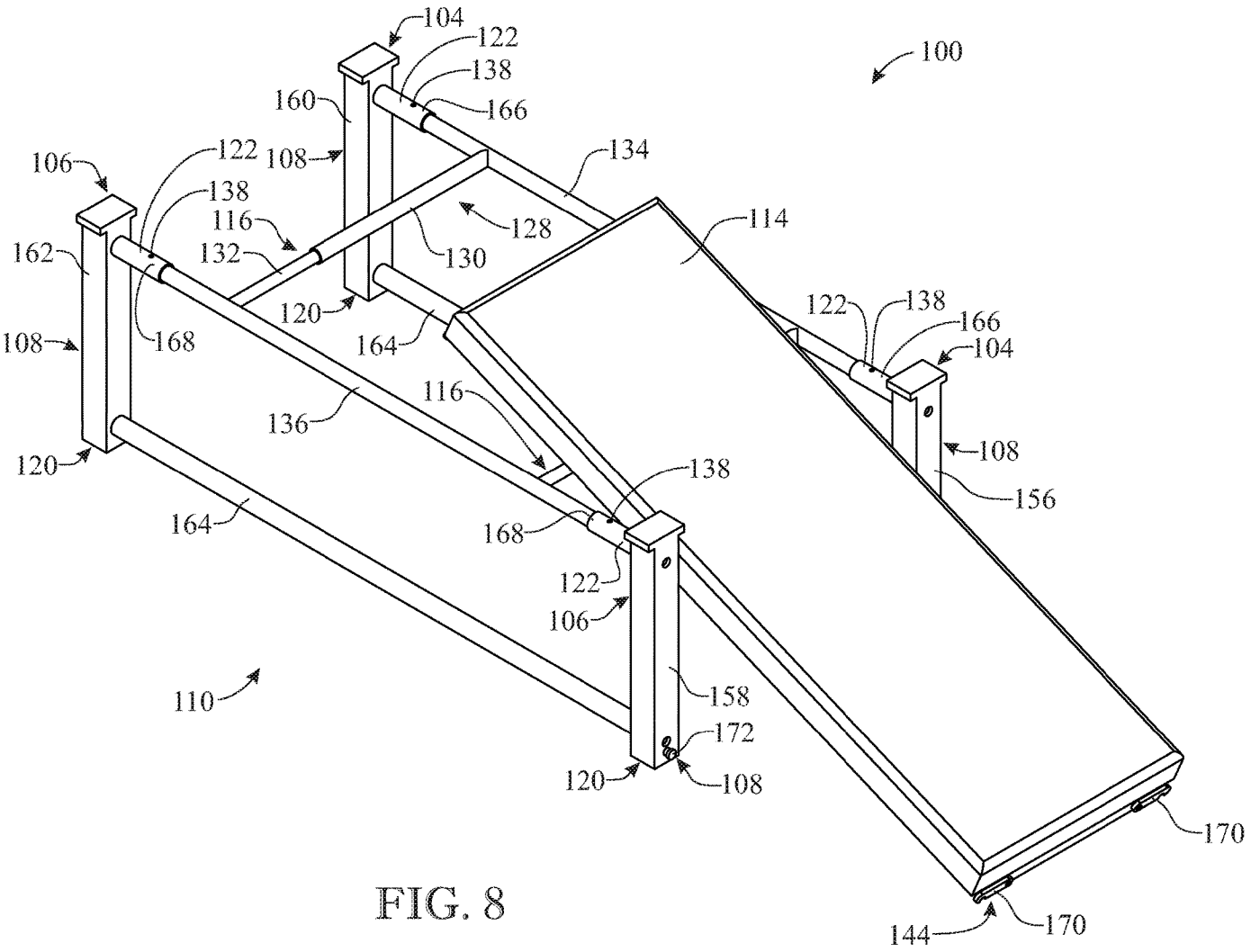
FIG. 8 presents an isometric top view of the exemplary exercise device of FIG. 1, where the panel is placed in an inclined position, in accordance with aspects of the invention.

The panel 114 may be removed or released from frame 102 and easily and rapidly placed in various configurations, thus facilitating performing a wide variety of physical exercises. For example, the illustration of FIG. 7 shows the legs 108 being adjusted such that the panel 114 is placed in between the first pair of legs 104 and the second pair of legs 106 and parallel to the floor on which the frame 102 sits. In this arrangement, the panel 114 may be referred to as being in a "recessed" position, in contrast to what may be referred to as a "non-recessed" position of the panel 114 illustrated in FIG. 1. In the recessed position, the panel 114 is positioned away from leg ends 120 (e.g., in closer proximity to lower ends of the legs 108 than to the upper leg ends 120). To accommodate the recessed arrangement, the first support bar 134 and the second support bar 136 (and the first pair of legs 104 and the second pair of legs 106) may be sufficiently spaced away from each other such that a distance therebetween is greater than a (e.g., width) dimension of the panel 114 to allow the panel 114 to be recessed into the frame 102. When placed in the recessed position, the panel 114 may also be detachably securable to the frame 102 via first securing mechanism 144. As another example, the illustration of FIG. 8 shows the panel 114 having been attached to frame 102 such that the panel 114 rests at an incline relative to the floor on which the frame 102 rests. In this arrangement, the panel 114 may be referred to as being in an "inclined" position wherein a plane of the panel 114 is obliquely angled relative to a plane of the frame 102 (e.g., the plane including the lower support bars 134 and 136, which is substantially parallel to the plane of the floor with the frame 102 resting thereon). The illustration of FIG. 2 shows the panel 114 including a second securing mechanism 146 to detachably secure the panel 114 onto the frame in an inclined position. For example, FIG. 2 shows an underside of the panel 114 and second securing mechanism 146 including a C-shaped clip that may rotatably attach to any part of the support assembly 110 while remaining substantially fixed relative to the panel 114. More particularly, FIG. 8 shows the frame 102 having been turned upside down, and the panel 114 having been detachably secured to the crossbar 116. As such, the panel 114 may be detachably and rotatably secured to the crossbar 116 and the entire frame 102 may rotate about a longitudinal axis of the C-shaped clip and the crossbar 116. For example, the frame 102 may be rotated such that coplanar longitudinal surfaces of a first leg 156 and a second leg 158 of legs 108 may engage a floor surface on which the frame 102 rests. This is defined herein as a "vertical" position (not shown) of the frame 102, and on the other hand, the position shown in FIG. 8 is defined as a "horizontal" position of the frame 102. It is to be understood that any number of C-shaped clips 152 may be included on panel 114 or frame 102 without departing from scope of this disclosure. For example, a plurality of spaced C-shaped clips 152 may allow a user to select different angles at which the panel 114 rests on frame 102. Further, the C-shaped clips 152 may take any appropriate form to clip onto crossbars 116. The second securing mechanism 146 may be detachably securable to any element of the frame 102. For example, the second securing mechanism 146 may be detachably securable to upper support bars 164 instead of the support assembly 110. It is to be understood that the second securing mechanism 146 may secure to the crossbar in the flat recessed position shown in FIG. 7 to secure the panel in this recessed position. As such two clips 152 may be included to clip onto the lower cross bars in the recessed position.

Figure 9:
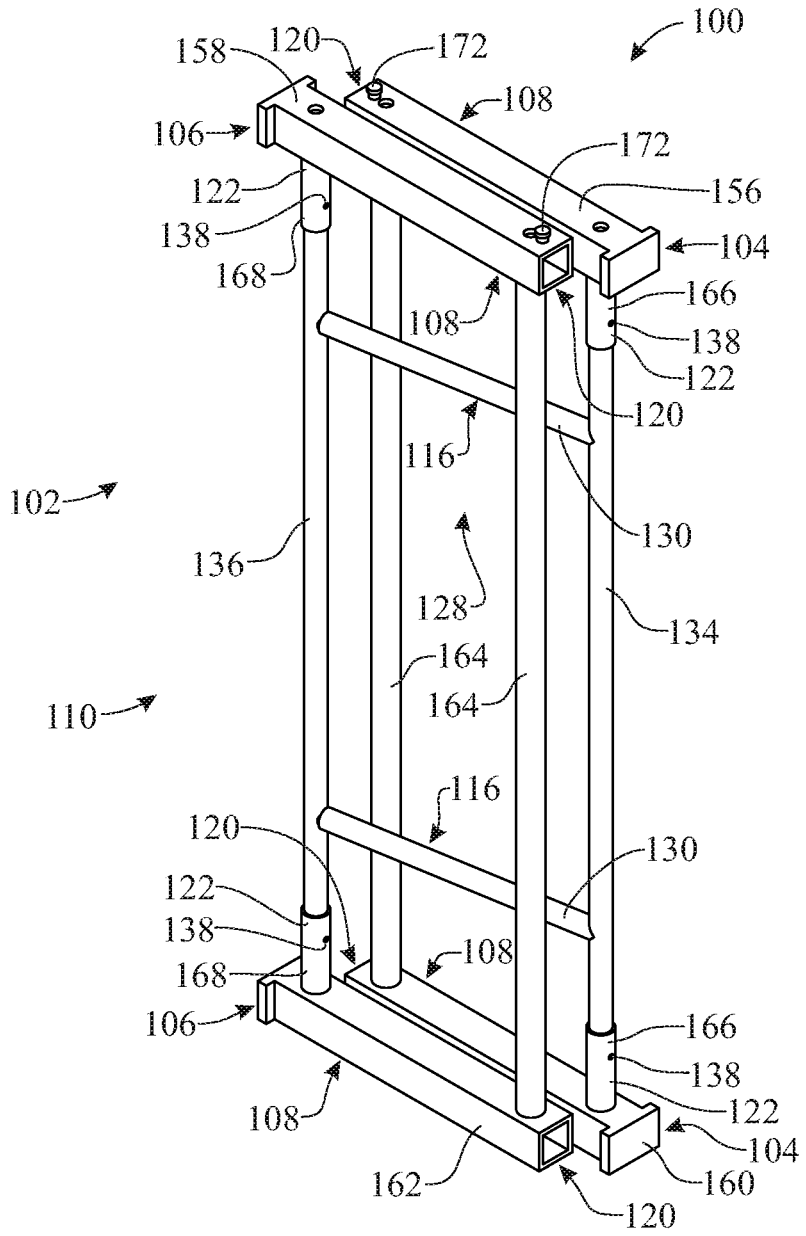
FIGS. 9-12 present perspective views of an unfolding sequence of a frame of the exercise device of FIG. 1, in accordance with aspects of the invention.

The exercise device 100 may fold flat for storage, or may fold flat to be used as a small exercise step by securably attaching or detachably securing the panel 114 to the frame 102 when the frame 102 is in a flat-folded configuration (e.g. the flat-folded configuration shown in FIG. 9).

Figure 10:
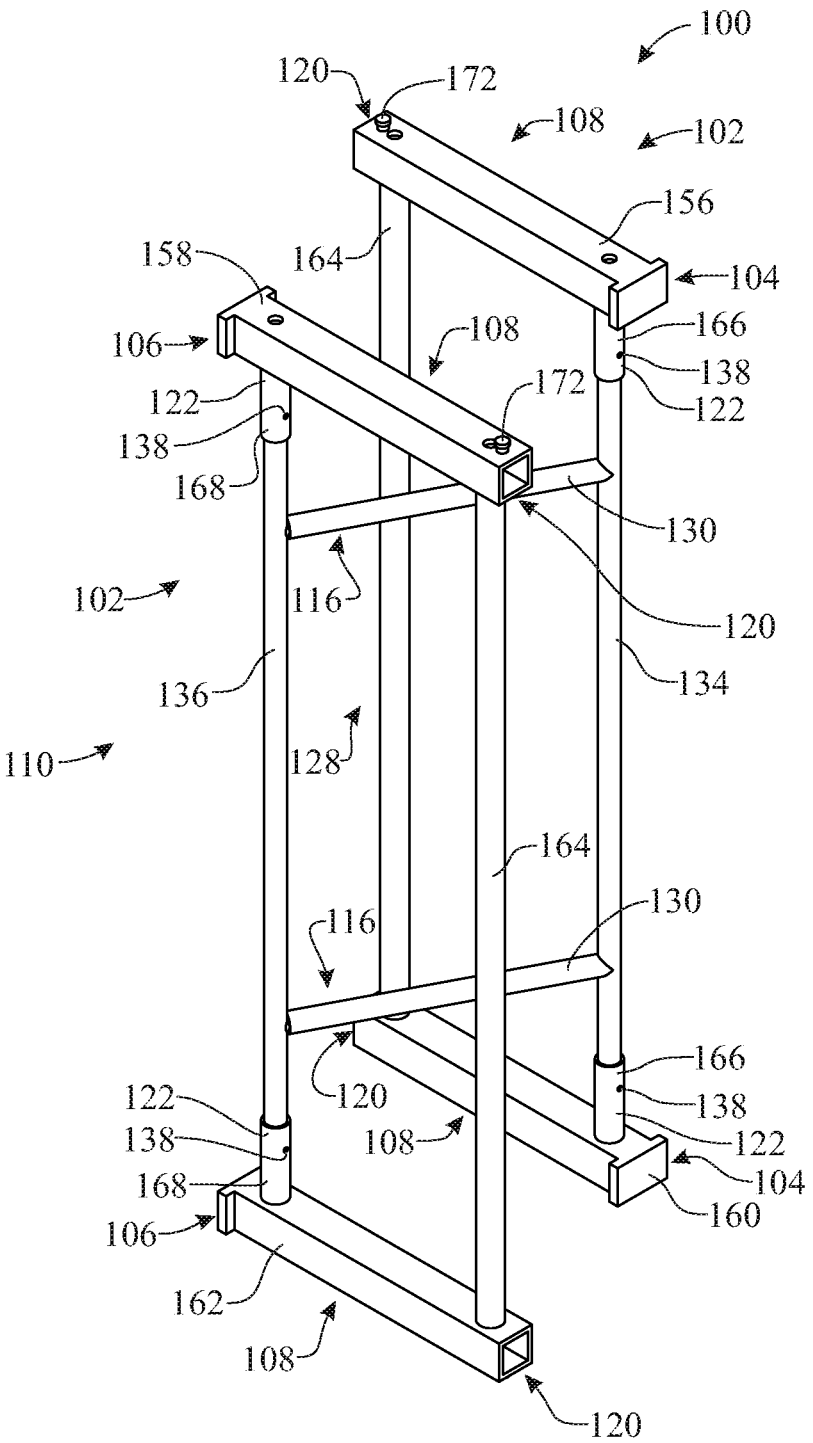
Figure 11:
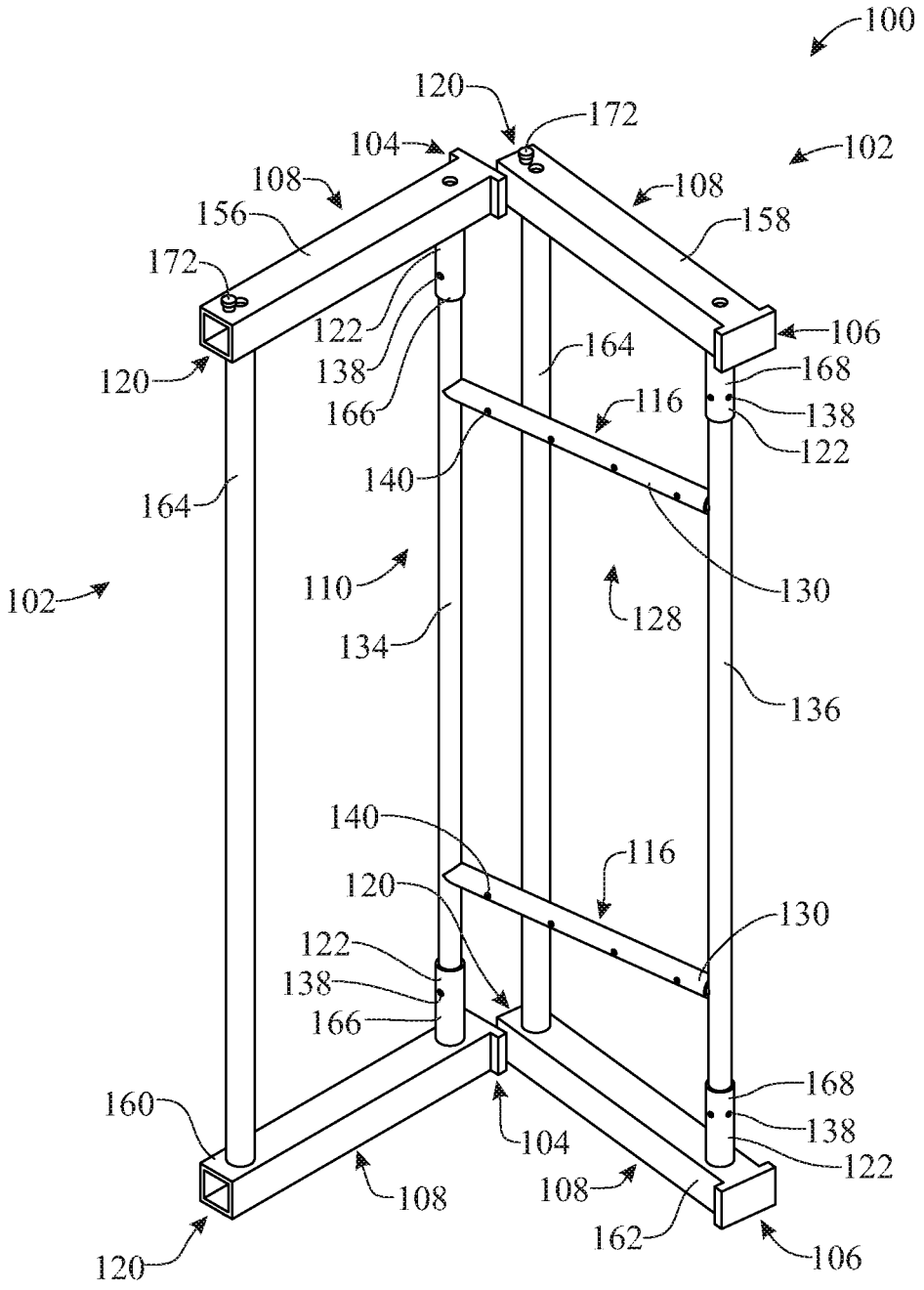
Figure 12:
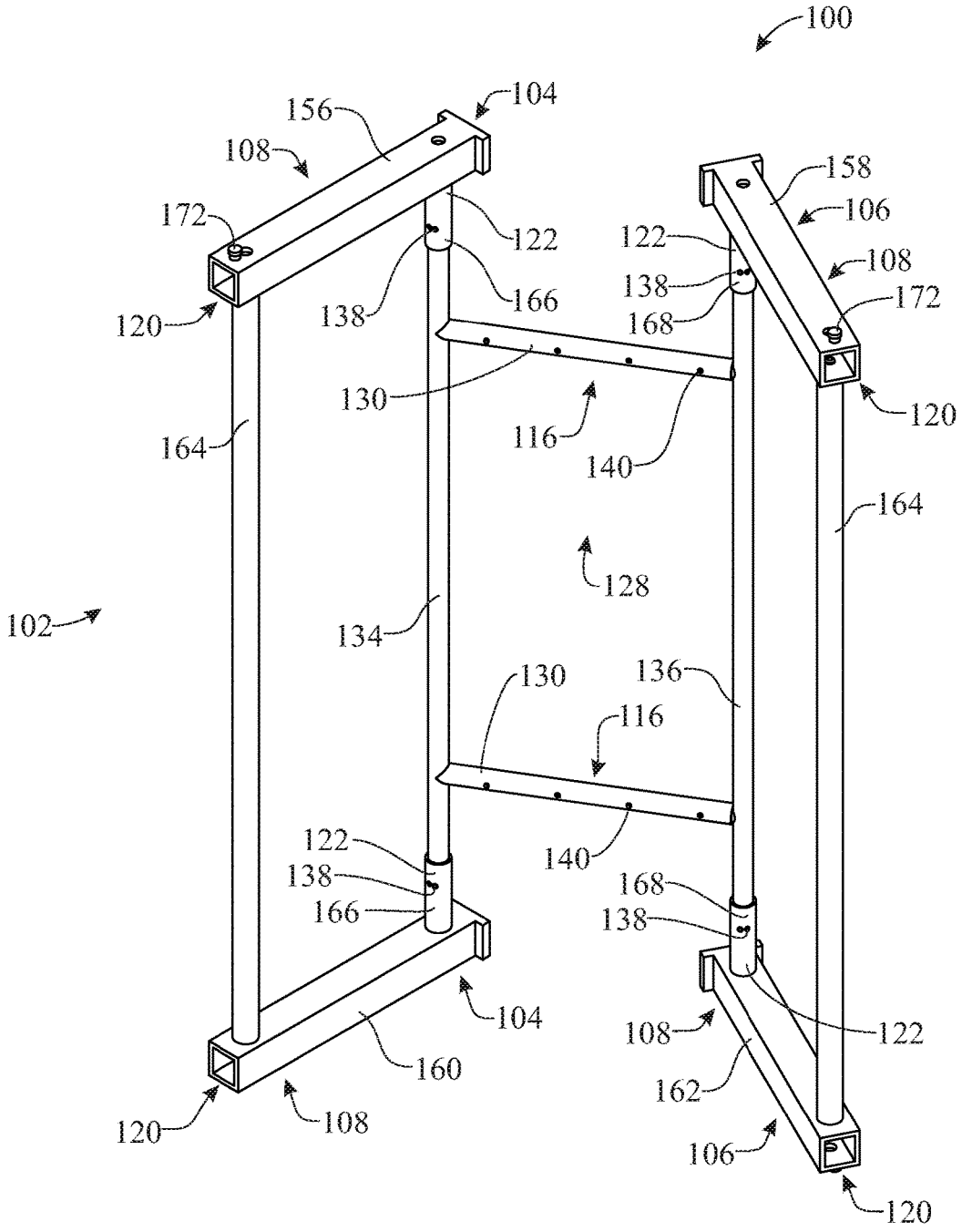

The illustrations of FIGS. 9-12 show an unfolding sequence of frame 102. More particularly, FIG. 9 shows the frame 102 having been completely folded flat, and FIGS. 10-12 show frame 102 in intermediate folding or unfolding configurations. The frame 102 may fold or unfold in various ways. For example, the frame 102 may fold by rotating first pair of legs 104 and second pair of legs 106 about a longitudinal axis of the lower support bars 134 and 136 of the support assembly when the spring button 126 is disengaged from the bracing holes 138. Hence, the legs 108 may be angularly separated by a variable angle that can be adjusted as desired. The first pair of legs 104 may rotate about a longitudinal axis of the first support bar 134 and the second pair of legs 106 may rotate about a longitudinal axis of the second support bar 136, for example. More particularly, first pair of legs 104 and second pair of legs 106 may rotate in opposite angular directions, such that the first pair of legs 104 and the second pair of legs 106 meet or mate and become substantially parallel to form the folded configuration shown in FIG. 9. As also shown in FIG. 9, the crossbars 116 may be nearly parallel (e.g., within 10°) to the first pair of legs 104 and the second pair of legs 106 in the folded configuration.

The above described structural variations and configurations provide a multifunctional exercise device that cures the deficiencies described in the background section. For example, when the frame 102 is assembled with the legs 108 secured in a vertical position, and when the panel 114 is secured to the frame 102 in a flat configuration, the exercise device 100 may be used as a flat bench for chest press exercises. Further, the configuration of the exercise device 100 in FIG. 7 enables a person to grip the upper support bars 164 to perform dip exercises, or mountain climber exercises. Further, a person may perform leg raise exercises by holding the upper support bars 164 and raising their legs while lying in a supine position on the panel 114. Even further, when the frame 102 is in the vertical position described above, a person may grab or hold third leg 160 and fourth leg 162 of legs 108 with each of their hands, respectively, to perform pull up exercises, dip exercises or knee up exercises with more clearing for vertical motion compared to the horizontal positioning of the frame. In the configuration of FIG. 8, when the frame 102 is in the horizontal position or vertical position described above, a person may perform incline bench press exercises or incline crunch exercises. For example, a person may place their feet underneath crossbar 116, to provide support and resistance to perform an incline crunch while lying supine on the inclined panel 114. Alternatively, a person may grab the crossbar 116 to perform leg raise exercises. As such, crossbar 116 may include various comfort pads or cushions to provide comfort during such an inclined crunch exercise. Further, in the folded configuration of FIG. 9, a person may hold the crossbars 116 to use the frame 102 as a weight to perform torso rotation exercises, shoulder press exercises or squat exercises as described in the background section. In the folded configuration, the panel 114 may be attached to the frame 102 to provide a small step for aerobic step exercises.

In conclusion, provided is a multipurpose exercise device that provides a full body workout, and conveniently folds flat for storage. The multipurpose exercise device allows a user to perform a wide variety of exercises using a single device, thus allowing the user to achieve complete physical training without having to make a costly investment, and without requiring a large amount of space for utilizing and storing the device.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A multifunctional exercise device, comprising:

a frame including a pair of legs;

a support assembly configured to support the pair of legs, the support assembly including a support bar detachably secured to the pair of legs;

a panel detachably secured to the frame via a securing mechanism, the panel being operable in a recessed position, a non-recessed position, and an inclined position relative to the frame when the panel is secured to the frame;

wherein the pair of legs is a first pair of legs, the frame further includes a second pair of legs, the support bar is a first lower support bar extending between the first pair of legs, and the support assembly further includes a second lower support bar extending between the second pair of legs;

wherein the support assembly further includes an adjustment mechanism configured to adjust a distance between the first pair of legs and the second pair of legs; and wherein the adjustment mechanism forms a crossbar extending between the first lower support bar and the second lower support bar, the securing mechanism is a first securing mechanism, the panel includes a second securing mechanism at an underside of the panel, and in the inclined position:

a plane of the panel is obliquely angled relative to a plane of the frame when the plane of the frame is substantially parallel to a horizontal support surface for the frame, and the panel is rotatably and detachably secured to the crossbar via the second securing mechanism.

2. The multifunctional exercise device of claim 1, wherein the frame further includes:

a first upper support bar extending between the first pair of legs; and a second upper support bar extending between the second pair of legs.

3. The multifunctional exercise device of claim 1, wherein the crossbar comprises and is formed from a first adjustment bar configured to receive a second adjustment bar via a spring button at one of a plurality of adjustment holes extending along the first adjustment bar, such that the first lower support bar and the second lower support bar are separated by a first distance with the second adjustment bar received by the first adjustment bar at a first of the plurality of adjustment holes, and separated by a second distance with the second adjustment bar received by the first adjustment bar at a second of the plurality of adjustment holes.

4. The multifunctional exercise device of claim 1, wherein in the non-recessed position: the panel is supported by upper ends of the of the first and second pairs of legs, and in the recessed position:

the panel is positioned away from the upper leg ends, and a dimension of the panel is less than the distance between the first pair of legs and the second pair of legs.

5. The multifunctional exercise device of claim 1, wherein the first and second support bars are selectively and detachably securable, respectively, to the first and second pairs of legs via respective bracings.

6. The multifunctional exercise device of claim 1, wherein the first securing mechanism includes two or more latches configured to latch onto corresponding receiving pins.

7. A multifunctional exercise device, comprising:

a frame including a first pair of legs and a second pair of legs;

a support assembly configured to support the first and second pairs of legs, the support assembly including a first lower support bar extending between the first pair of legs, and a second lower support bar extending between the second pair of legs;

an adjustment mechanism for selectively adjusting a distance between the first and second lower support bars;

a panel detachably secured to the frame via a securing mechanism, wherein with the panel detached from the frame, the first pair of legs is angularly separable from the second pair of legs by a variable angle;

wherein the adjustment mechanism includes a first adjustment bar attached to the first lower support bar and configured to receive a second adjustment bar attached to the second lower support bar, the first adjustment bar including a plurality of adjustment holes for receiving a spring button of the second adjustment bar, such that the first lower support bar and the second lower support bar are separated by a first distance with the second adjustment bar received by the first adjustment bar at a first of the plurality of adjustment holes, and separated by a second distance with the second adjustment bar received by the first adjustment bar at a second of the plurality of adjustment holes; and wherein with the panel detached from the frame, the frame is foldable flat with the first adjustment bar and the second adjustment bar being nearly parallel to the first pair of legs and the second pair of legs.

8. The multifunctional exercise device of claim 7, wherein the frame further includes:

a first upper support bar extending between the first pair of legs; and a second upper support bar extending between the second pair of legs.

9. The multifunctional exercise device of claim 7, wherein with the panel detached from the frame, the variable angle with which the first pair of legs is angularly separable from the second pair of legs is selected by rotating one or both of:

the first pair of legs about a longitudinal axis of the first lower support bar; and the second pair of legs about a longitudinal axis of the second lower support bar.

10. The multifunctional exercise device of claim 7, wherein the first and second adjustment bars form a crossbar extending between the first lower support bar and the second lower support bar, and the panel includes a second securing mechanism at an underside of the panel, the panel being rotatably and detachably secured to the crossbar via the second securing mechanism such that the panel is inclined relative to a plane of the frame when the plane of the frame is substantially parallel to a horizontal support surface for the frame.

11. The multifunctional exercise device of claim 7, wherein the first and second adjustment bars form a crossbar extending between the first lower support bar and the second lower support bar, and in a recessed position:

the panel is positioned away from upper ends of the first pair of legs and the second pair of legs, the panel is in contact with the crossbar, and a dimension of the panel is less than the distance between the first lower support bar and the second lower support bar.

12. A multifunctional exercise device, comprising:

a frame, the frame including:

a first pair of legs;

a second pair of legs;

a first upper support bar extending between the first pair of legs; and a second upper support bar extending between the second pair of legs;

a support assembly configured to support the first and second pairs of legs, the support assembly including a first lower support bar attached to the first pair of legs via a first respective bracing pair, and a second lower support bar attached to the second pair of legs via a second respective bracing pair;

an adjustment mechanism for selectively adjusting a distance between the first and second lower support bars, the adjustment mechanism including a crossbar extending between the first lower support bar and the second lower support bar and having a variable length;

a panel detachably secured to the frame via a securing mechanism, the panel being operable in a recessed position, a non-recessed position, and an inclined position relative to the frame when the panel is secured to the frame; and wherein each of the bracings of the first and second respective bracing pairs includes at least one bracing hole configured to receive a spring button, and the first and second lower support bars are detachably secured to the first and second pairs of legs, respectively, when spring buttons are respectively received by each of the bracings.

13. The multifunctional exercise device of claim 12, wherein the panel includes a C-shaped clip at an underside of the panel, wherein in the inclined position, a plane of the panel is obliquely angled relative to a plane of the frame when the plane of the frame is substantially parallel to a horizontal support surface for the frame, and wherein in the inclined position, the C-shaped clip is configured for variably angling the plane of the panel by being rotatably and detachably secured to the crossbar.

* * * * *